US010611530B2

(12) United States Patent
Sakamoto

(10) Patent No.: US 10,611,530 B2
(45) Date of Patent: Apr. 7, 2020

(54) DISCHARGE CONTAINER

(71) Applicant: YOSHINO KOGYOSHO CO., LTD., Tokyo (JP)

(72) Inventor: Satoshi Sakamoto, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/315,021

(22) PCT Filed: Jun. 16, 2017

(86) PCT No.: PCT/JP2017/022329
§ 371 (c)(1),
(2) Date: Jan. 3, 2019

(87) PCT Pub. No.: WO2018/042827
PCT Pub. Date: Mar. 8, 2018

(65) Prior Publication Data

US 2019/0233179 A1 Aug. 1, 2019

(30) Foreign Application Priority Data

Aug. 31, 2016 (JP) ..... 2016-170218

(51) Int. Cl.
*B65D 47/18* (2006.01)
*B65D 47/20* (2006.01)
(Continued)

(52) U.S. Cl.
CPC ..... *B65D 47/18* (2013.01); *B05B 1/3006* (2013.01); *B65D 47/122* (2013.01); *B65D 47/20* (2013.01)

(58) Field of Classification Search
CPC ..... B65D 47/18; B65D 47/122; B65D 47/20; B05B 1/3006
See application file for complete search history.

(56) References Cited

U.S. PATENT DOCUMENTS

2011/0068133 A1* 3/2011 Painchaud ..... B65D 47/18 222/494
2018/0086516 A1* 3/2018 Sakimura ..... B65D 47/20
(Continued)

FOREIGN PATENT DOCUMENTS

CN 201604874 U 10/2010
CN 201745890 U 2/2011
(Continued)

OTHER PUBLICATIONS

Aug. 8, 2017 International Search Report issued in International Patent Application No. PCT/JP2017/022329.
(Continued)

*Primary Examiner* — Donnell A Long
(74) *Attorney, Agent, or Firm* — Oliff PLC

(57) ABSTRACT

A discharge container includes: a discharge nozzle that is mounted on a mouth portion of a container body and in the ceiling wall portion of which a discharge hole for discharging contents is formed; an inside plug disposed inside the discharge nozzle and wherein a communication hole for bringing the discharge hole and the inside of the container body into communication is formed; and a valve body for closing the communication hole so as to allow opening as necessary. The valve body includes: a valve portion disposed above the communication hole's opening circumferential edge of the inside plug so as to separate freely upward therefrom; a topped cylinder-shaped main body portion that is disposed below the valve portion and a bottom opening of which opens toward the inside of the container body; and a connecting portion that connects the valve portion's lower part with the main body portion's top wall.

4 Claims, 3 Drawing Sheets

(51) Int. Cl.
*B05B 1/30* (2006.01)
*B65D 47/12* (2006.01)

(56) References Cited

U.S. PATENT DOCUMENTS

| | | | | |
|---|---|---|---|---|
| 2018/0251273 | A1* | 9/2018 | Murase | B65D 25/42 |
| 2018/0251274 | A1* | 9/2018 | Hashimoto | B65D 41/04 |

FOREIGN PATENT DOCUMENTS

| | | | |
|---|---|---|---|
| CN | 103764516 | A | 4/2014 |
| JP | H06-278758 | A | 10/1994 |
| JP | 2013-049484 | A | 3/2013 |
| JP | 2015-006917 | A | 1/2015 |
| JP | 2016-088581 | A | 5/2016 |
| KR | 20-0464780 | Y1 | 1/2013 |

OTHER PUBLICATIONS

Aug. 2, 2019 Office Action issued in Chinese Patent Application No. 201780038701.6.

* cited by examiner

DISCHARGE CONTAINER

TECHNICAL FIELD

The present invention relates to a discharge container

Priority is claimed on Japanese Patent Application No. 2016-170218, filed Aug. 31, 2016, the content of which is incorporated herein by reference.

BACKGROUND ART

As a conventional discharge container, for example, as disclosed in Patent Document 1, a discharge container including a container main body in which contents are stored, a discharge nozzle formed in a cylindrical shape with a top, mounted on a mouth portion of the container main body and having a top wall portion in which a discharge hole for discharging the contents is formed, and a discharge valve disposed inside the discharge nozzle and blocking communication between the discharge hole and an inside of an inner container such that the communication can be freely made is known.

In this discharge container, a locking post which is locked to an upper surface of the discharge valve is vertically provided on a lower surface of the top wall portion of the discharge nozzle. As the locking post presses the upper surface of the discharge valve, when the container main body is squeezed and deformed (compressed and deformed), it is possible to separate, from a discharge valve seat, only a flange-shaped valve portion of the discharge valve which is brought into pressure contact with the discharge valve seat. When the valve portion is separated from the discharge valve seat, the discharge hole communicates with the inside of the container main body, and the contents stored in the container main body are discharged from the discharge hole.

DOCUMENT OF RELATED ART

Patent Document

Patent Document 1: Japanese Unexamined Patent Application, First Publication No. 2013-49484

SUMMARY OF INVENTION

Technical Problem

In such a discharge container, when an operation of a valve body becomes heavy, a squeezing force (pushing pressure) at the time of discharging the contents may become high, and usability may be deteriorated. Meanwhile, when the valve portion is simply made easy to deform (interference with the valve portion is reduced) in order to lighten the operation of the valve body, airtightness deteriorates, and external air may enter the inside of the container main body which has a negative pressure after the contents are discharged.

The present invention has been made in view of such circumstances, and an object thereof is to provide a discharge container capable of reducing a squeezing force when contents are discharged while maintaining airtightness.

Solution to Problem

A discharge container according to the present invention includes a container main body in which contents are stored and which is elastically deformable, a discharge nozzle which is formed in a cylindrical shape with a top, is mounted on a mouth portion of the container main body, and has a ceiling wall portion in which a discharge hole configured to discharge the contents is formed, an inside plug which is disposed inside the discharge nozzle and in which a communication hole configured to allow the discharge hole to communicate with an inside of the container main body is formed, and a valve body which is configured to close the communication hole such that the communication hole is able to be opened, in which the valve body includes a valve portion disposed on an opening circumferential edge of the communication hole in the inside plug such that the valve portion is separable upward from the opening circumferential edge, a main body portion which is formed in a cylindrical shape with a top and is disposed below the valve portion and in which a bottom opening which opens toward an inside of the container main body is formed, and a connecting portion which connects a lower portion of the valve portion with a top wall portion of the main body portion, and an upper surface of the valve portion is spaced apart downward from the ceiling wall portion of the discharge nozzle.

According to the discharge container of the present invention, when the container main body is squeezed and pressurized, a pressure is applied to the valve body which is configured to close the communication hole of the inside plug disposed inside the discharge nozzle such that the communication hole is able to be opened. The valve body includes the valve portion disposed on the opening circumferential edge of the communication hole in the inside plug such that the valve portion is separable upward from the opening circumferential edge, the main body portion which is formed in a cylindrical shape with a top and is disposed below the valve portion and in which the bottom opening which opens toward the inside of the container main body is formed, and the connecting portion which connects the lower portion of the valve portion with the top wall portion of the main body portion. The pressure when the container main body is pressurized is applied not only to the valve portion but also to the lower surface of the top wall portion of the main body portion, and thus the main body portion moves slightly upward.

Here, since the upper surface of the valve portion is spaced apart downward from the ceiling wall portion of the discharge nozzle, interference with the valve portion is alleviated by an amount by which the main body portion moves upward. Therefore, it is possible to open and close the valve portion with a smaller squeezing force than that in the conventional case in which only the valve portion is opened and closed.

A lower surface of the top wall portion of the main body portion may be formed in a plane perpendicular to a central axis of the mouth portion of the container main body.

In this case, since the pressure when the container main body is pressurized can be received by a plane perpendicular to a movement direction of the main body portion in a lower surface of the top wall portion of the main body portion, the main body portion easily moves upward.

A thickness of an outer circumferential portion of the top wall portion of the main body portion may be smaller than a thickness of a circumferential wall portion of the main body portion and may also be smaller than a thickness of the connecting portion.

In this case, the top wall portion of the main body portion is more easily deformed than the circumferential wall portion and the connecting portion of the main body portion.

Since the top wall portion of the main body portion receives a pressure at the time of pressurizing the container main body at the lower surface, the main body portion easily moves upward due to making the top wall portion easy to deform.

Advantageous Effects of Invention

According to the discharge container of the present invention, it is possible to reduce a squeezing force when contents are discharged while maintaining airtightness.

DESCRIPTION OF EMBODIMENTS

Hereinafter, an embodiment of the present invention will be described with reference to the drawings.

Figure 1:
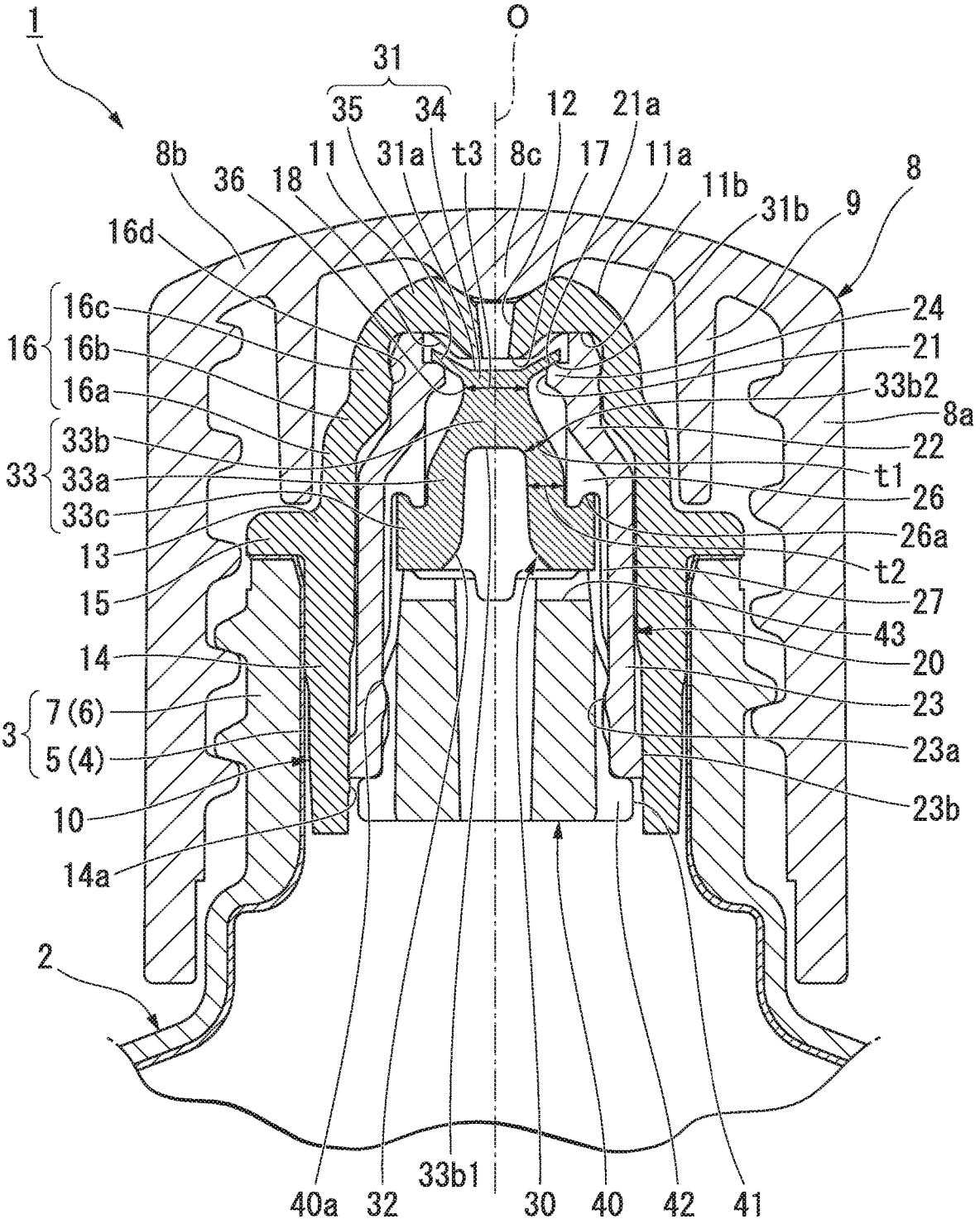
FIG. 1 is a longitudinal cross-sectional view of a discharge container according to an embodiment of the present invention.

As shown in FIG. 1, a discharge container 1 includes a container main body 2 in which contents are stored and which is elastically deformable, a discharge nozzle 10 which is formed in a cylindrical shape with a top, is mounted on a mouth portion 3 of the container main body 2, and has a ceiling wall portion 11 in which a discharge hole 12 for discharging the contents is formed, an inside plug 20 which is disposed inside the discharge nozzle 10 and in which a communication hole 21 for allowing the discharge hole 12 to be communicating with an inside of an inner container 4 is formed, a valve body 30 which closes the communication hole 21 such that the communication hole 21 is able to be opened, and a cap 8 which is detachably mounted on the mouth portion 3 of the container main body 2 and covers the discharge hole 12.

The container main body 2 is formed in a cylindrical shape with a bottom, the cap 8 is formed in a cylindrical shape with a top, and the container main body 2 and the cap 8 are disposed coaxially on a common axis. This common axis is a central axis which passes through a center of the mouth portion 3 of the container main body 2. Hereinafter, this common axis is referred to as a central axis O, and a direction along the central axis O is referred to as a vertical direction. Also, a side of a bottom of the container main body 2 in the vertical direction is referred to as a lower side, and a side of the mouth portion 3 of the container main body 2 in the vertical direction is referred to as an upper side. Further, in a plan view when seen in the vertical direction, a direction orthogonal to the central axis O is referred to as a radial direction, and a direction of circling around the central axis O is referred to as a circumferential direction.

The container main body 2 is a so-called delamination container including an inner container 4 in which contents are stored and which is flexible and is deformed as the amount of contents decreases, and an outer container 6 in which the inner container 4 is installed and which is elastically deformable. The container main body 2 is formed in a cylindrical shape with a bottom in which the mouth portion 3, a shoulder portion, a trunk portion and a bottom portion (not shown) are continuously formed from an upper side to a lower side. A portion of the outer container 6 located at least on the trunk portion is formed to be elastically deformable (squeezable and deformable) toward an inside of the container main body. The inner container 4 is deformed so that a volume thereof is reduced due to squeezing deformation of the outer container 6.

The mouth portion 3 has a structure in which a mouth portion 5 of the inner container 4 and a mouth portion 7 of the outer container 6 are stacked on each other. An annular folded portion protruding outward in the radial direction is formed at an upper end of the mouth portion 5 of the inner container 4, and the folded portion is disposed on an upper end opening edge of the mouth portion 7 of the outer container 6.

Here, an external air introduction hole (not shown) passing through the outer container 6 is formed in the outer container 6. The external air introduction hole introduces external air between the outer container 6 and an outer surface of the inner container 4 which is separated from the outer container 6 and deformed so that the volume thereof is reduced. The external air introduction hole may be provided in the mouth portion, the trunk portion, the bottom portion or the like, and a formation position thereof is not limited.

The discharge nozzle 10 includes the ceiling wall portion 11 and a circumferential wall portion 13 which extends downward from an outer circumferential edge of the ceiling wall portion 11, and the ceiling wall portion 11 and the circumferential wall portion 13 are disposed coaxially on the central axis O. The circumferential wall portion 13 includes a seal cylindrical portion 14 formed in a lower portion thereof and fitted into the mouth portion 3 of the container main body 2 in a liquid-tight manner, an annular flange portion 15 which protrudes radially outward from an upper end edge of the seal cylindrical portion 14 and extends in the circumferential direction, and a connecting cylindrical portion 16 which extends upward from the upper end edge of the seal cylindrical portion 14 and is connected to the outer circumferential edge of the ceiling wall portion 11.

An inner circumferential surface of the seal cylindrical portion 14 is formed so that a diameter of a lower portion thereof is slightly larger than that of an upper portion thereof.

An engagement protrusion **14*a* which protrudes inward in the radial direction is formed on a lower portion of the inner circumferential surface of the seal cylindrical portion 14**.

The flange portion 15 is disposed on an upper end opening edge of the mouth portion 3.

The connecting cylindrical portion 16 includes a lower portion **16*a* which extends straight upward from the upper end edge of the seal cylindrical portion 14, an intermediate portion 16*b* which extends upward from an upper end edge of the lower portion 16*a* while a diameter thereof gradually reduces toward an upper side, and an upper portion 16*c* which extends upward from an upper end edge of the intermediate portion 16*b* and is connected to the outer circumferential edge of the ceiling wall portion 11. An inner diameter of the lower portion 16*a* is formed to be the same as that of the upper portion of the seal cylindrical portion 14**.

An inner circumferential surface of the upper portion **16*c* extends in a straight line in the vertical direction. A protrusion 16*d* protruding inward in the radial direction is formed on an inner circumferential surface of the upper portion 16*c***.

The discharge hole 12 passing through the ceiling wall portion 11 in the vertical direction is formed in a center portion of the ceiling wall portion 11. The discharge hole 12 is disposed coaxially on the central axis O, and a diameter thereof gradually increases from a lower side toward an upper side. A radially inner portion of an upper surface 11*a* of the ceiling wall portion 11 is formed in a concavely curved surface shape having a circular shape located coaxially on the central axis O in a top view. A radially outer portion of the upper surface 11*a* of the ceiling wall portion 11 is formed in a convexly curved surface shape which gradually extends downward as it goes outward in the radial direction and is smoothly connected to an outer circumferential surface of the upper portion 16*c* of the connecting cylindrical portion 16 of the circumferential wall portion 13.

An expanded portion 17 which protrudes downward is formed on the lower surface 11*b* of the ceiling wall portion 11. The expanded portion 17 is formed in an inverted truncated cone shape located coaxially on the central axis O. Further, a plurality of protruding ribs 18 are formed on the lower surface 11*b* of the ceiling wall portion 11 at intervals in the circumferential direction. The protruding ribs 18 protrude radially outward from a circumferential surface of the expanded portion 17 formed in an inverted truncated cone shape. The discharge hole 12 opens in a lower end surface of the expanded portion 17.

The inside plug 20 is formed in a cylindrical shape disposed coaxially on the central axis O. The inside plug 20 includes an upper cylindrical portion 22 fitted into the upper portion 16*c* of the connecting cylindrical portion 16 of the discharge nozzle 10, and a lower cylindrical portion 23 connected to a lower end of the upper cylindrical portion 22 and fitted into the seal cylindrical portion 14 of the discharge nozzle 10.

An upper end edge of the upper cylindrical portion 22 is in contact with a portion of the lower surface 11*b* of the ceiling wall portion 11 of the discharge nozzle 10 which is located radially outward of the expanded portion 17. An annular valve seat 24 which protrudes inward in the radial direction is formed on an inner circumferential surface of an upper end of the upper cylindrical portion 22. An upper surface of the valve seat 24 is located below an upper end opening edge of the inside plug 20. The inside of the valve seat 24 serves as the above-described communication hole 21. An inner circumferential surface of the upper cylindrical portion 22 extends in a straight line in the vertical direction to have the same diameter on both upper and lower sides with the valve seat 24 interposed therebetween.

An inner circumferential surface of the lower cylindrical portion 23 of the inside plug 20 has a larger diameter than the inner circumferential surface of the upper cylindrical portion 22 and extends in a straight line in the vertical direction. An engagement protrusion 23*a* which protrudes inward in the radial direction is formed on the inner circumferential surface of a lower end portion of the lower cylindrical portion 23. An annular engagement ring portion 23*b* which protrudes outward in the radial direction and extends in the circumferential direction is formed on an outer circumferential surface of the lower end portion of the lower cylindrical portion 23. A lower end of the engagement ring portion 23*b* is locked to an upper end of the engagement protrusion 14*a* of the seal cylindrical portion 14 of the discharge nozzle 10. Therefore, the inside plug 20 is fitted to the engagement protrusion 14*a* inside the discharge nozzle 10 in a state in which the inside plug 20 is prevented from falling off from the discharge nozzle 10.

A stepped portion 26 which protrudes downward from a connecting portion between the inner circumferential surface of the upper cylindrical portion 22 and the inner circumferential surface of the lower cylindrical portion 23 is formed on an inner circumferential surface of the inside plug 20. An outer circumferential portion of a stepped surface 26*a* of the stepped portion 26 which faces downward is recessed upward. A plurality of stepped portions 26 are formed on the inner circumferential surface of the inside plug 20 at intervals in the circumferential direction. Also, a plurality of longitudinal ribs 27 which extend in the vertical direction are formed on the inner circumferential surface of the inside plug 20 at intervals in the circumferential direction. The longitudinal ribs 27 extend downward from the stepped surface 26*a*. The stepped portion 26 and the longitudinal rib 27 are formed at the same circumferential position on the inner circumferential surface of the inside plug 20. Circumferential lengths of the stepped portion 26 and the longitudinal rib 27 are equal to each other.

The valve body 30 is a check valve which restricts a flow of a fluid from an upper side (a side of the discharge hole 12) to a lower side (a side of the inner container 4) but permits a flow in the opposite direction. The valve body 30 is formed of an elastically deformable soft material such as nitrile rubber, butyl rubber, silicon rubber, an elastomer, urethane or the like. The valve body 30 includes a valve portion 31 disposed on an opening circumferential edge 21*a* of the communication hole 21 in the inside plug 20 such that the valve portion 31 is separable upward from the opening circumferential edge 21*a*, a main body portion 33 which is formed in a cylindrical shape with a top and is disposed below the valve portion 31 and in which a bottom opening 32 which opens toward the inside of the container main body 2 is formed, and a connecting portion 36 which connects a lower portion of the valve portion 31 with a top wall portion 33*b* of the main body portion 33, and the valve portion 31, the main body portion 33 and the connecting portion 36 are formed integrally.

The valve portion 31 includes a disk-shaped center portion 34 disposed coaxially on the central axis O, and an annular circumferential edge portion 35 which extends, from an outer circumferential edge of the center portion 34, gradually upward as it goes outward in the radial direction. An upper surface 31*a* of the valve portion 31 is formed in a concave shape which is recessed downward.

The center portion 34 is disposed to face the lower end surface of the expanded portion 17 of the discharge nozzle 10 with a space therebetween. An outer diameter of an upper surface of the center portion 34 is equal to an outer diameter of the lower end surface of the expanded portion 17.

The circumferential edge portion 35 is elastically deformable upward and seated on the upper surface of the valve seat 24 such that the circumferential edge portion 35 is separable upward from the upper surface of the valve seat 24. The circumferential edge portion 35 is seated on the valve seat 24 in a state in which the circumferential edge portion 35 is elastically deformed upward, and thus a lower surface of the circumferential edge portion 35 is brought into close contact with the valve seat 24 from an upper side due to an elastic restoring force. At this time, a portion of the upper surface 31*a* of the valve portion 31 at which the circumferential edge portion 35 is located is spaced apart downward from the protruding ribs 18 of the ceiling wall portion 11 and an outer circumferential edge portion of the upper surface 31*a* is located above the lower end surface of the expanded portion 17. In this way, the upper surface 31*a* of the valve portion 31 is separated downward from the ceiling wall portion 11 of the discharge nozzle 10, and the expanded portion 17 enters inside the upper surface 31*a* of the valve portion 31.

The main body portion 33 has a cylindrical circumferential wall portion 33*a*, the top wall portion 33*b* connected to an upper end edge of the circumferential wall portion 33*a*, and a leg portion 33*c* connected to a lower end edge of the circumferential wall portion 33*a*. The leg portion 33*c* is disposed inside the lower cylindrical portion 23 of the inside plug 20. An outer diameter of the leg portion 33*c* is larger than an inner diameter of the upper cylindrical portion 22 of the inside plug 20 and smaller than an inner diameter of the lower cylindrical portion 23 of the inside plug 20. An inner circumferential surface of the leg portion 33*c* is formed in a convexly curved surface shape of which a diameter gradually reduces from a lower end edge thereof toward an upper side. An outer circumferential portion of an upper surface of the leg portion 33*c* protrudes upward and enters the outer circumferential portion of the stepped surface 26*a* of the inside plug 20 which is recessed upward. Thus, the upper surface of the leg portion 33*c* and the stepped surface 26*a* of the inside plug 20 come into close contact with each other, and deformation of the leg portion 33*c* toward a radially inner side to decrease the diameter thereof is restricted.

The circumferential wall portion 33*a* is disposed inside the upper cylindrical portion 22 of the inside plug 20, and a lower end edge of the circumferential wall portion 33*a* is connected to the upper end edge of the leg portion 33*c*. An outer circumferential surface of the circumferential wall portion 33*a* extends straight upward from the lower end edge thereof along the inner circumferential surface of the upper cylindrical portion 22 of the inside plug 20, and then a diameter thereof gradually reduces toward an upper side. An inner circumferential surface of the circumferential wall portion 33*a* is connected to the bottom opening 32, is formed continuously with the inner circumferential surface of the leg portion 33*c*, and extends straight upward from the inner circumferential surface of the leg portion 33*c*.

The top wall portion 33*b* has a lower surface 33*b*1 which closes an upper opening of the circumferential wall portion 33*a*, and an outer circumferential portion 33*b*2 connected to the upper end edge of the circumferential wall portion 33*a*. The lower surface 33*b*1 of the top wall portion 33*b* is formed in a plane perpendicular to the central axis O of the mouth portion 3 of the container main body 2. An outer circumferential edge of the lower surface 33*b*1 of the top wall portion 33*b* is connected to an upper end edge of the inner circumferential surface of the circumferential wall portion 33*a*. The outer circumferential edge of the lower surface 33*b*1 of the top wall portion 33*b* and the upper end edge of the inner circumferential surface of the circumferential wall portion 33*a* are smoothly connected by a curved surface.

An outer circumferential surface of the top wall portion 33*b* is continuously formed with the outer circumferential surface of the circumferential wall portion 33*a*, and a diameter thereof gradually reduces toward an upper side. The outer circumferential portion 33*b*2 is formed to be the thinnest at a connecting portion (a corner portion) between the lower surface 33*b*1 of the top wall portion 33*b* and the inner circumferential surface of the circumferential wall portion 33*a*. A thickness t1 of the outer circumferential portion 33*b*2 is smaller than a thickness t2 of the circumferential wall portion 33*a*. That is, the thickness t1 of the outer circumferential portion 33*b*2 is smaller than any of a cylindrical portion of the circumferential wall portion 33*a*, whose diameter in the outer circumferential surface is constant, and a reduced diameter portion of the circumferential wall portion 33*a*, whose diameter in the outer circumferential surface gradually reduces toward an upper side.

The connecting portion 36 connects a lower surface 31*b* of the valve portion 31, which has an inverted conical shape of which a diameter gradually reduces toward a lower side, with the outer circumferential surface of the top wall portion 33*b* of which a diameter gradually reduces toward an upper side. The lower surface 31*b* of the valve portion 31 and the outer circumferential surface of the top wall portion 33*b* are smoothly connected by a curved surface.

The connecting portion 36 forms a constricted portion of the valve body 30 having a minimum diameter. A thickness t3 (the diameter of the constricted portion) of the connecting portion 36 is larger than the thickness t1 of the outer circumferential portion 33*b*2 of the top wall portion 33*b*. That is, the thickness t1 of the outer circumferential portion 33*b*2 is smaller than the thickness t2 of the circumferential wall portion 33*a* and is also smaller than the thickness t3 of the connecting portion 36.

A cylindrical pressing cylinder member 40 is fitted to a portion of the inside plug 20 located below the valve body 30, and restricts the valve body 30 having the above-described constitution from moving downward. An upper opening of the pressing cylinder member 40 faces the bottom opening 32 of the valve body 30, and a bottom opening of the pressing cylinder member 40 opens toward the inside of the container main body 2. An upper end edge of the pressing cylinder member 40 is in contact with a lower end surface of the leg portion 33*c* of the valve body 30 from a lower side. A plurality of grooves 43 extending at a constant depth in the radial direction are formed in an upper surface of the pressing cylinder member 40 at intervals in the circumferential direction. A plurality of support protruding portions 41 protruding outward in the radial direction are formed on a lower end edge of the pressing cylinder member 40 at intervals in the circumferential direction. Upper surfaces of the support protruding portions 41 are in contact with the lower end edge of the inside plug 20 from a lower side.

An engagement protrusion 40*a* protruding outward in the radial direction is formed on an outer circumferential surface of a circumferential wall portion of the pressing cylinder member 40. A lower end of the engagement protrusion 40*a* is locked to an upper end of the engagement protrusion 23*a* of the inside plug 20. Accordingly, the pressing cylinder member 40 is fitted into the inside plug 20 in a state in which the pressing cylinder member 40 is prevented from falling off.

Further, a plurality of longitudinal ribs 42 extending in the vertical direction are formed on an outer circumferential surface of the pressing cylinder member 40 at intervals in the circumferential direction. The longitudinal ribs 42 connect the engagement protrusion 40*a* with the support protruding portions 41. For example, the longitudinal ribs 42 are formed at the same circumferential positions as the longitudinal ribs 27 of the inside plug 20.

The cap 8 is formed in a cylindrical shape with a top, and a female screw portion screwed to a male screw portion formed on an outer circumferential surface of the mouth portion 7 of the outer container 6 is formed on an inner circumferential surface of a circumferential wall portion 8*a* of the cap 8. The cap 8 has a surrounding cylinder 9 which extends downward and surrounds an upper portion of the discharge nozzle 10 from an outer side in the radial direction. Also, a protruding portion 8*c* protruding downward is formed at a center portion of a top wall 8*b* of the cap 8. The protruding portion 8*c* is in contact with the upper surface 11*a* of the ceiling wall portion 11 of the discharge nozzle 10 to close the discharge hole 12.

Hereinafter, an operation of the discharge container 1 of the embodiment will be described.

When the contents are discharged from the discharge container 1, first, the cap 8 is removed from the mouth portion 3 of the container main body 2 to expose the discharge hole 12, and the discharge container 1 is set in an inverted posture or an inclined posture in which the mouth portion 3 is located at the lower side and the bottom portion (not shown) of the container main body 2 is located at the upper side. When the outer container 6 of the container main body 2 is squeezed and deformed from this state, the inner container 4 is deformed together with the outer container 6, and a volume of the inner container 4 is reduced. Due to this volume reduction deformation, an internal pressure of the inner container 4 becomes a positive pressure, the valve portion 31 is opened by the positive pressure, and thus the discharge hole 12 and the inside of the inner container 4 communicate with each other.

Here, the valve body 30 includes the valve portion 31 disposed on the opening circumferential edge 21*a* of the communication hole 21 in the inside plug 20 such that the valve portion 31 is separable upward from the opening circumferential edge 21*a*, the main body portion 33 which is formed in a cylindrical shape with a top and is disposed below the valve portion 31 and in which the bottom opening 32 which opens toward the inside of the container main body 2 is formed, and the connecting portion 36 which connects the lower portion of the valve portion 31 with the top wall portion 33*b* of the main body portion 33. A pressure when the container main body 2 is pressurized is applied not only to the valve portion 31 but also to the lower surface 33*b*1 of the top wall portion 33*b* of the main body portion 33 via the bottom opening 32, and thus the main body portion 33 moves slightly upward. More specifically, the upper portion from the lower surface 33*b*1 of the top wall portion 33*b* moves upward by the internal pressure of the inner container 4. That is, the outer circumferential portion 33*b*2 of the top wall portion 33*b* is elastically deformed to be stretched. Also, since the pressing cylinder member 40 is formed in a cylindrical shape and the bottom opening of the pressing cylinder member 40 opens toward the inside of the container main body 2, the pressure when the container main body 2 is pressurized is easily applied to the lower surface 33*b*1 of the top wall portion 33*b*, and the outer circumferential portion 33*b*2 can be easily elastically deformed.

Here, since the upper surface 31*a* of the valve portion 31 is spaced apart downward from the ceiling wall portion 11 of the discharge nozzle 10, the main body portion 33 is allowed to move upward, and the interference with the valve portion 31 is alleviated by an amount by which the main body portion 33 moves upward. Therefore, it is possible to open the valve portion 31 with a smaller squeezing force than that in the conventional case in which only the circumferential edge portion 35 of the valve portion 31 is deformed. When the valve portion 31 is opened, the contents in the inner container 4 pass through the inside and outside of the pressing cylinder member 40 and a space between the longitudinal ribs 27 of the inside plug 20 and then pass through the communication hole 21. The contents which have passed through the communication hole 21 flow into a space between the upper surface 31*a* of the valve portion 31 and the lower surface 11*b* of the ceiling wall portion 11 of the discharge nozzle 10 and are discharged from the discharge hole 12.

When the internal pressure of the inner container 4 decreases after the contents are discharged, the valve portion 31 is closed and communication between the discharge hole 12 and the inside of the inner container 4 is blocked. As the valve portion 31 is closed, the inner container 4 is sealed, and then by releasing the squeeze deformation, the outer container 6 tries to deform to restore to its original state.

At this time, since the inner container 4 is sealed, a negative pressure is generated between the outer container 6 and the inner container 4. Then, external air is introduced between the outer container 6 and the inner container 4 through the above-described external air introduction hole.

In this way, as the external air is introduced between the outer container 6 and the inner container 4, a shape of the inner container 4 of which the volume is reduced is maintained.

As described above, the discharge operation of the contents using the discharge container 1 is completed.

Figure 2:
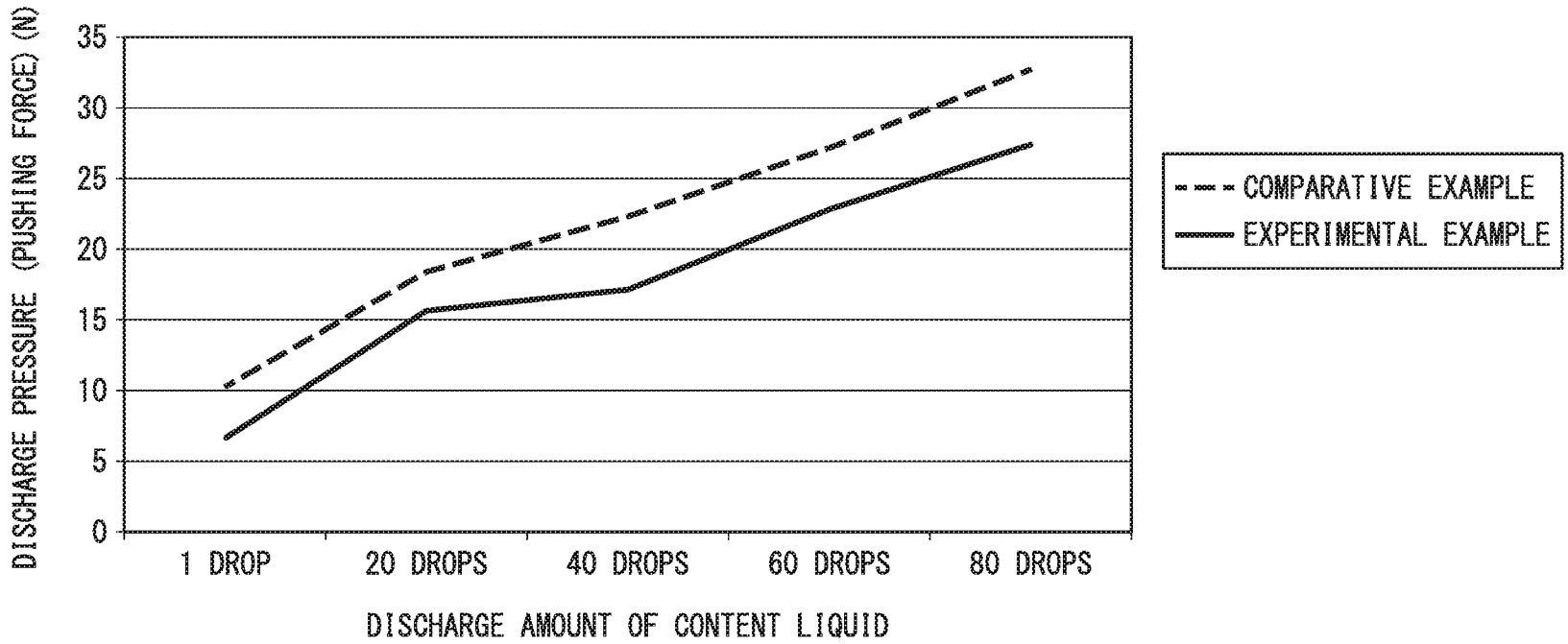
FIG. 2 is a graph showing a discharge performance of the discharge container shown in FIG. 1.

FIG. 2 is a graph showing a discharge performance of the discharge container 1 shown in FIG. 1. In FIG. 2, a longitudinal axis indicates a discharge pressure (pushing force, or squeezing force), and a horizontal axis indicates a discharge amount of the content liquid (the contents). Also, in FIG. 2, an experimental example is the discharge container 1 (the delamination container) having the constitution shown in FIG. 1, and a comparative example is a container in which the bottom opening 32 is closed (the internal pressure is not applied to the lower surface 33*b*1 of the top wall portion 33*b*) compared with the discharge container 1 shown in FIG. 1. The graph shown in FIG. 2 shows a measurement results of the discharge pressure when about 4 ml of water is filled in the discharge container 1 having a capacity of about 5 ml and about 0.04 ml per drop is discharged by squeeze. As apparent from FIG. 2, it can be understood that, when the discharge amount of the content liquid is increased, the discharge pressure becomes high, and a large squeezing force (pushing force) is required, but the squeezing force is smaller in the experimental example in which the bottom opening 32 opens toward the inside of the container main body 2 than in the comparative example in which the bottom opening 32 is closed.

As described above in detail, the discharge container 1 of the embodiment can open and close the valve body 30 with a low squeezing force as compared with the constitution which deforms only the valve portion 31. That is, in the discharge container 1 of the embodiment, since the squeezing force can be reduced without changing a design of the interference with the valve portion 31, the airtightness of the valve portion 31 can maintain conventional performance.

Therefore, according to the embodiment, it is possible to obtain the discharge container 1 capable of reducing the squeezing force when the contents are discharged while maintaining the airtightness.

Also, as shown in FIG. 1, since the lower surface 33*b*1 of the top wall portion 33*b* of the main body portion 33 is formed in a plane perpendicular to the central axis O of the mouth portion 3 of the container main body 2, on the lower surface 33*b*1 of the top wall portion 33*b* of the main body portion 33, the pressure when the container main body 2 is pressurized can be received at a plane perpendicular to a movement direction of the main body portion 33, and the main body portion 33 easily moves upward. Therefore, it is possible to further reduce the squeezing force when the contents are discharged.

Also, since the thickness t1 of the outer circumferential portion 33*b*2 of the top wall portion 33*b* of the main body portion 33 is smaller than the thickness t2 of the circumferential wall portion 33*a* of the main body portion 33 and is also smaller than the thickness t3 of the connecting portion 36, the top wall portion 33*b* of the main body portion 33 is more easily deformed than the circumferential wall portion 33*a* of the main body portion 33 or the connecting portion 36. Since the top wall portion 33*b* of the main body portion 33 receives the pressure when the container main body 2 is pressurized at the lower surface 33*b*1, the upper portion from the lower surface 33*b*1 of the main body portion 33 becomes easier to move upward by making this outer circumferential portion 33*b*2 easier to deform. Therefore, it is possible to further reduce the squeezing force when the contents are discharged.

Figure 3:
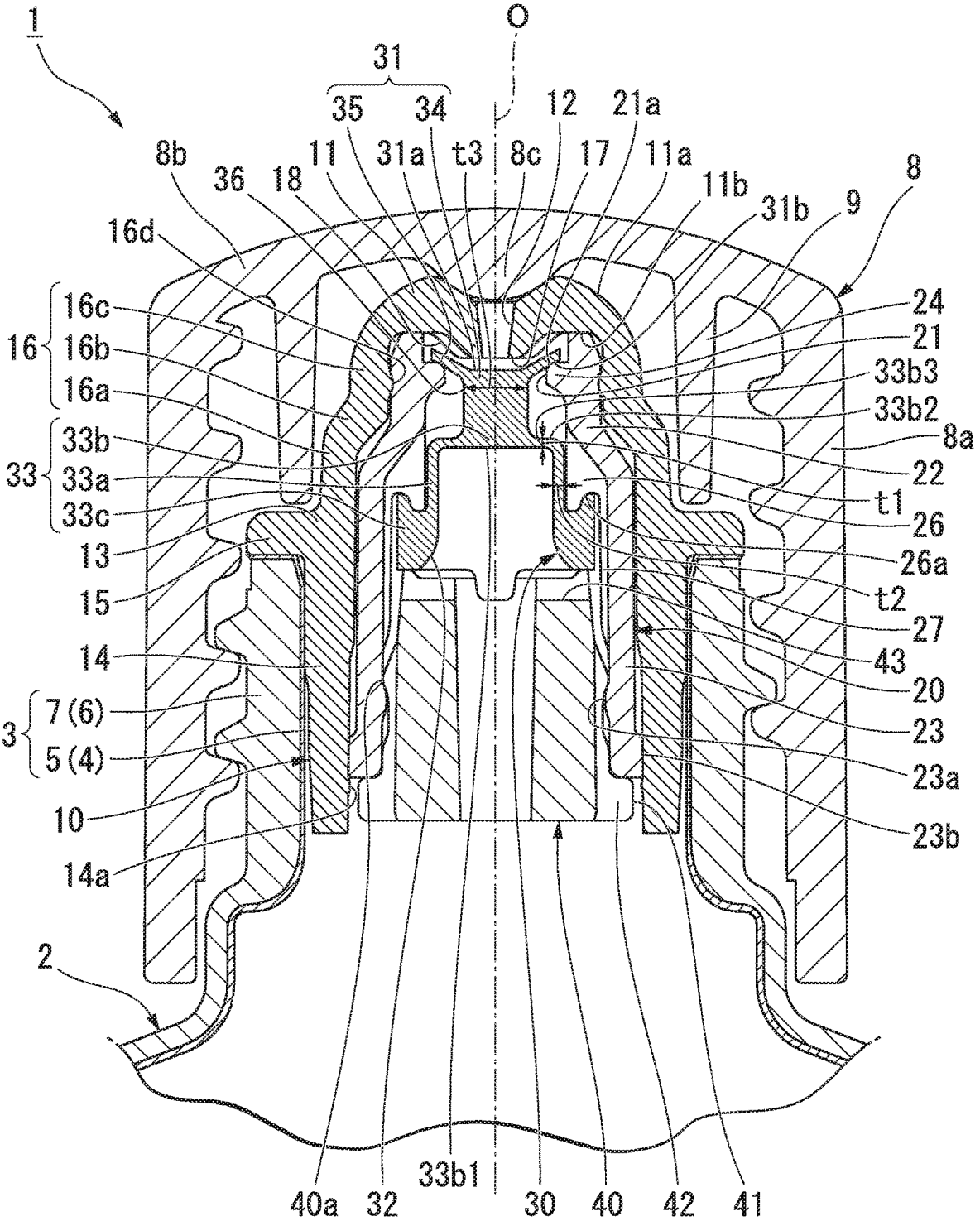
FIG. 3 is a longitudinal cross-sectional view of a discharge container according to a modified example of the embodiment of the present invention.

As shown in FIG. 3, the top wall portion 33*b* itself of the main body portion 33 may be thinned. The top wall portion 33*b* has an upper surface 33*b*3 parallel to the lower surface 33*b*1, and the thickness t1 between the lower surface 33*b*1 and the upper surface 33*b*3 is smaller than the thickness t2 of the circumferential wall portion 33*a* and is also smaller than the thickness t3 of the connecting portion 36. According to such a constitution, since the top wall portion 33*b* itself is formed to be thin in a direction in which the main body portion 33 moves due to the pressure when the container main body 2 is pressurized, the upper portion from the lower surface 33*b*1 of the main body portion 33 easily moves upward. Therefore, it is possible to reduce the squeezing force when the contents are discharged. Also, in the constitution shown in FIG. 3, the thickness t2 of the circumferential wall portion 33*a* of the main body portion 33 is formed to be smaller than that in FIG. 1 to form the upper surface 33*b*3 parallel to the lower surface 33*b*1. Then, since an area of the lower surface 33*b*1 is relatively increased and thus a large pressure receiving area is ensured when the container main body 2 is pressurized, the upper portion from the lower surface 33*b*1 of the main body portion 33 more easily moves upward.

The present invention is not limited to the above-described embodiment described with reference to the drawings, and various modifications are conceivable in the technical scope thereof.

For example, in the above-described embodiment, the container main body 2 is a so-called delamination container in which the inner container 4 is separably stacked on the inner surface of the outer container 6. However, the present invention is not limited thereto, and the container main body 2 may be a single container of only the inner container 4 or the outer container 6, or may be a double container in which the inner container 4 and the outer container 6 are separately formed.

Further, the container main body 2 may have a constitution in which an adhesive layer is provided between the inner container 4 and the outer container 6.

In addition, it is possible to appropriately replace the constituent elements in the above-described embodiment with well-known constituent elements without departing from the spirit of the present invention.

INDUSTRIAL APPLICABILITY

According to the discharge container of the present invention, it is possible to reduce the squeezing force when the contents are discharged while maintaining the airtightness.

DESCRIPTION OF REFERENCE SIGNS

1 Discharge container
2 Container main body
3 Mouth portion
6 Outer container
10 Discharge nozzle
11 Ceiling wall portion
12 Discharge hole
20 Inside plug
21 Communication hole
21*a* Opening circumferential edge
30 Valve body
31 Valve portion
31*a* Upper surface
32 Bottom opening
33 Main body portion
33*a* Circumferential wall portion
33*b* Top wall portion
33*b*1 Lower surface
33*b*2 Outer circumferential portion
36 Connecting portion
O Central axis

The invention claimed is:

1. A discharge container comprising:

a container main body in which contents are stored and which is elastically deformable;

a discharge nozzle which is formed in a cylindrical shape with a top, is mounted on a mouth portion of the container main body, and has a ceiling wall portion in which a discharge hole configured to discharge the contents is formed;

an inside plug which is disposed inside the discharge nozzle and in which a communication hole configured to allow the discharge hole to communicate with an inside of the container main body is formed; and a valve body which is configured to close the communication hole such that the communication hole is able to be opened, wherein the valve body includes a valve portion disposed on an opening circumferential edge of the communication hole in the inside plug such that the valve portion is separable upward from the opening circumferential edge, a main body portion which is formed in a cylindrical shape with a top and is disposed below the valve portion and in which a bottom opening which opens toward an inside of the container main body is formed, and a connecting portion which connects a lower portion of the valve portion with a top wall portion of the main body portion, an upper surface of the valve portion is spaced apart downward from the ceiling wall portion of the discharge nozzle, a valve seat is formed on the inside plug, the valve portion includes a center portion, and a circumferential edge portion which extends from an outer circumferential edge of the center portion, and a lower surface of the circumferential edge portion is seated of the valve seat.

2. The discharge container according to claim 1, wherein a lower surface of the top wall portion of the main body portion is formed in a plane perpendicular to a central axis of the mouth portion of the container main body.

3. The discharge container according to claim 2, wherein a thickness of an outer circumferential portion of the top wall portion of the main body portion is smaller than a thickness of a circumferential wall portion of the main body portion and is smaller than a thickness of the connecting portion.

4. The discharge container according to claim 1, wherein a thickness of an outer circumferential portion of the top wall portion of the main body portion is smaller than a thickness of a circumferential wall portion of the main body portion and is smaller than a thickness of the connecting portion.

* * * * *